US009334577B2

(12) United States Patent
Kock et al.

(10) Patent No.: US 9,334,577 B2
(45) Date of Patent: May 10, 2016

(54) MULTIFUNCTIONAL COATING OF ALUMINIUM PIECES

(75) Inventors: Erich Kock, Bremen (DE); Philippe Vulliet, Cran-Gevrier (FR)

(73) Assignee: Airbus Operations GmbH, Hamburg (DE)

( * ) Notice: Subject to any disclaimer, the term of this patent is extended or adjusted under 35 U.S.C. 154(b) by 945 days.

(21) Appl. No.: 12/866,055

(22) PCT Filed: Jan. 7, 2009

(86) PCT No.: PCT/EP2009/050138

§ 371 (c)(1), (2), (4) Date: Feb. 7, 2011

(87) PCT Pub. No.: WO2009/098099

PCT Pub. Date: Aug. 13, 2009

(65) Prior Publication Data

US 2011/0120873 A1 May 26, 2011

Related U.S. Application Data

(60) Provisional application No. 61/065,145, filed on Feb. 8, 2008.

(30) Foreign Application Priority Data

Feb. 8, 2008 (DE) ..... 10 2008 008 055

(51) Int. Cl.

| | |
|---|---|
| ***C23C 28/00*** | (2006.01) |
| ***C25D 11/08*** | (2006.01) |
| ***C23C 22/56*** | (2006.01) |

(Continued)

(52) U.S. Cl.

CPC ..... *C25D 11/08* (2013.01); *C23C 22/56* (2013.01); *C23C 22/83* (2013.01); *C25D 11/16* (2013.01)

(58) Field of Classification Search

CPC ..... C25D 9/06; C25D 11/08; C25D 11/12; C25D 11/16; C23C 28/00; C23C 20/04; C23F 17/00

USPC ..... 205/175, 188, 190

See application file for complete search history.

(56) References Cited

U.S. PATENT DOCUMENTS

| | | | | |
|---|---|---|---|---|
| 4,085,012 | A | 4/1978 | Marceau et al. | |
| 4,894,127 | A | 1/1990 | Wong et al. | |
| 4,992,115 | A * | 2/1991 | Ikeda | C23C 22/44 148/247 |

(Continued)

FOREIGN PATENT DOCUMENTS

| | | | |
|---|---|---|---|
| EP | 1 233 084 | 8/2002 | |
| WO | WO 2005005559 A1 * | 1/2005 | C09D 5/08 |

OTHER PUBLICATIONS

Domingues et al., "Corrosion Behavior of Environmentally Friendly Treatments for Aluminum Alloys", Key Engineering Materials (no month, 2002), vols. 230-232, pp. 392-395.*

(Continued)

*Primary Examiner* — Edna Wong

(74) *Attorney, Agent, or Firm* — Greer, Burns & Crain, Ltd.

(57) ABSTRACT

The invention relates to a method for application of a multi-functional coating to the surface of a workpiece made from aluminum or an aluminum alloy. The invention further relates to a workpiece, which may be produced by such a method.

18 Claims, 2 Drawing Sheets

(51) Int. Cl.
*C23C 22/83* (2006.01)
*C25D 11/16* (2006.01)

(56) References Cited

U.S. PATENT DOCUMENTS

| | | | | |
|---|---|---|---|---|
| 5,192,374 | A * | 3/1993 | Kindler | C23C 22/83 148/272 |
| 5,362,335 | A * | 11/1994 | Rungta | 148/272 |
| 5,486,283 | A | 1/1996 | Mnich | |
| 5,932,083 | A * | 8/1999 | Stoffer et al. | 205/261 |
| 2002/0157961 | A1* | 10/2002 | Dattilo et al. | 205/328 |
| 2004/0020568 | A1* | 2/2004 | Phelps | C23C 22/34 148/273 |

OTHER PUBLICATIONS

Bibilashvili, "Use of a Catalyst in Plasma Anodizing of Metals and Semiconductors", Fizika i Khimiya Obrabotki Materialov (no month, 2001), No. 5, pp. 40-42. Abstract Only.*

Domingues et al., "Corrosion Behaviour of Environmentally Friendly Treatments for Aluminium Alloys", Key Engineering Materials (no month, 2002), vols. 230-232, pp. 392-395.*

Office Action issued by the State Intellectual Property Office of the PRC, dated Jun. 15, 2011, with English translation.

L. Domingues et al., "Corrosion Behaviour of Environmentally Friendly Treatments for Aluminum Alloys," Key Engineering Materials, vols. 230-232 (2002) pp. 392-395.

V. Moutarlier, et al., "An electrochemical approach to the anodic oxidation of A1 2024 alloy in sulfuric acid containing inhibitors," Surface and coatings Technology 161 (2002) pp. 267-274.

L. Domingues, et al., "Corrosion Behaviour of Environmentally Friendly Treatments for Aluminium Alloys", *Key Engineering Materials*, vol. 230-232, 2002, pp. 392-395.

M. Dabala, et al., "Corrosion Resistance of Cerium-Based Chemical Conversion Coatings on AA5083 Aluminium Alloy", *Materials and Corrosion*, vol. 55, No. 5, 2004, pp. 381-386.

V. Moutarlier, et al., "An Electrochemical Approach to the Anodic Oxidation of A1 2024 Alloy in Sulfuric Acid Containing Inhibitors", *Surface & Coatings Technology*, vol. 161, 2002, pp. 267-274.

Xingwen Yu, et al., "Electrochemical Study of the Corrosion Behavior of Ce Sealing of Anodized 2024 Aluminum Alloy", *Thin Solid Films*, vol. 423, 2003, pp. 252-256.

* cited by examiner

MULTIFUNCTIONAL COATING OF ALUMINIUM PIECES

CROSS-REFERENCE TO RELATED APPLICATIONS

This application claims the benefit of U.S. Provisional Application No. 61/065,145, filed Feb. 8, 2008 and German Patent Application No. 10 2008 008 055.1, filed Feb 8, 2008, the entire disclosures of which are herein incorporated by reference.

FIELD OF THE INVENTION

The present invention relates to a method for applying a multifunctional coating to the surface of a workpiece made of aluminium or an aluminium alloy. The invention further relates to a workpiece which can be produced by a method of this type.

The purpose of applying an anodised layer to aluminium workpieces is to alter the surface characteristics. Anodised layers are layers which can have different surface morphologies and pore structures, depending on test parameters. The purpose of an anodised layer can be substantially reduced into three functionalities: they are to increase the corrosion protection of the basis material and to exhibit a surface structure which is suitable for adhesive bondings and/or for painting.

In the following, known anodising methods are listed with their main characteristics:

1. Chromic acid anodising, CAA. Chromic acid anodising according to DIN EN 3002 provides an anodised layer which is corrosion-resistant. At the same time, the surface morphology of a chromic acid anodised layer is constituted such that it can be used for components which are to be painted. Bonding adherends are treated by this method provided that before anodising, a chromium sulphuric acid pickling agent is applied. For normal colour coating, a pickling agent without a specific oxide structure based on Fe (III)-containing pickling agents is sufficient. Approximately 90% of all aluminium components presently used, for example by Airbus, in aircraft construction are provided with the CAA layer.

2. Phosphoric acid-boric sulphuric acid anodising, PBSA. This method is described in U.S. Pat. No. 5,486,283. The layers produced by this method are characterised by a corrosion resistance. At the same time, they serve as adhesion promoters for paints and are suitable as substrate for adhesive bonds provided that the actual anodising method is preceded by a further anodic method which produces a fine, ramified oxide structure on the outer surface (phosphoric acidic desmutting: PAD).

3. Phosphoric acid anodising, PAA. This method is described in British patent GB 1 555 940. A patent aimed specifically at the adhesive characteristics of PAA is provided by U.S. Pat. No. 4,085,012. Phosphoric acid anodising provides an anodised layer, the surface morphology of which is suitable for bonding adherends, provided that a chromium-sulphuric acid pickling (FPL) is used.

4. Phosphoric-sulphuric acid anodising, PSA. This method is used by Airbus and is set out as a technical note with designation TN-EVC 904/96. PSA anodised layers are suitable for adhesive bonds and for coatings and are used as chromate-free reference anodised layers.

5. Boric sulphuric acid anodising, BSAA. This method is described in U.S. Pat. No. 4,894,127. The layers produced by this method are characterised by a corrosion resistance. At the same time, they serve as adhesion promoters for paints. An outstanding adhesion behaviour is achieved when the actual anodising method is preceded by a further anodic method which produces a fine, ramified oxide structure on the outer surface (phosphoric acid desmutting—PAD).

6. Direct current sulphuric acid anodising, GSA according to FA 80-T-35-2000: Direct current sulphuric acid anodised surfaces are characterised by a high corrosion resistance. They are not usually suitable for adhesive bonding and for paints. Treatment before anodising is carried out by a pickling agent without a specific oxide structure based on Fe(III)-containing pickling agents.

7. Mixed acid anodising (tartaric acid-sulphuric acid anodising), TSA. The surfaces produced in this method, for example according to European patent EP 1 233 084 A2 are characterised by a corrosion resistance. They are suitable for the application of paints, but exhibit adhesion weaknesses in the standard pickling treatment based on Fe(III)-containing pickling agents without a specific oxide structure.

However, these methods suffer from the following disadvantages:

Re: 1) Chromate-containing baths are used for the production of chromic acid anodised (CAA) layers; chromates are classified as carcinogenic. Thus, these methods will not be used in future applications.

Re: 2) The duplex process PBSA does not have any technical disadvantages, but in terms of installation, necessitates a second anodising process entailing considerable investment expense.

Re: 3) The layer produced in phosphoric acid anodising PAA does not afford a satisfactory corrosion protection for the entire spectrum of parts in aircraft construction, and requires a CSA pickling.

Re: 4) The phosphoric-sulphuric acid anodised layer PSA does not provide corrosion protection.

Re: 5) Sulphuric-boric anodised layers BSAA are only suitable for adhesive bonds if a second PAD bath is connected upstream.

Re: 6) Direct current sulphuric acid anodised layers are unsuitable for painting and adhesive bonding.

Re: 7) Mixed acid anodising TSA is unsuitable for adhesive bonds and has a reduced performance profile for chromate-free paints.

In addition thereto, it is known to treat aluminium workpieces with Ce (IV)-containing cleaning solutions. For example, U.S. Pat. No. 6,503,565 describes the pre-treatment of metal surfaces to prepare them for subsequent treatments (application of conversion layers).

SUMMARY OF THE INVENTION

In contrast thereto, the object of the present invention is to provide a method for applying a multifunctional coating to the surface of a workpiece consisting of aluminium or an aluminium alloy and a correspondingly coated workpiece which meets all three requirements: corrosion resistance, suitability for painting and suitability as a substrate for adhesive bonds, within a technical process chain.

This and further objects are achieved by the subject-matter of the independent claims. Preferred embodiments are set out in the subclaims.

A pickling process which is adjusted in a particular manner is used in the present invention. The pickling process is chromate-free and produces oxide structures, as known by CSA (chromium-sulphuric acid pickling). In order to be able to use this resulting oxide for performance in connection with paint or bond application, the anodising process is to be modified such that as a result, the outer pickling oxide layer is retained.

Consequently, it is also possible to use relatively fine-pore eloxal layers, as are effective in SAA or mixed electrolytes based on sulphuric acid.

The invention is characterised by the production of an oxide film on workpieces made of aluminium or aluminium alloys. After being conventionally cleaned in grease removing and alkaline pickling baths, the aluminium components are subsequently introduced, for example into a Ce (IV)-containing picking bath and for further treatment are anodised such that the oxide layer which was produced in the cerium-containing pickling bath is not completely destroyed again. The cerium pickling process is characterised by the application of an approximately 50 nm thick, heavily-pored layer (hair brush-like; see FIG. 1). This layer is suitable for high adhesive bonds.

The anodising step allows a low-pored layer to grow underneath the first layer, produces electrolytes in SAA or TSA. This layer can be subsequently compacted and is thus corrosion resistant (see FIG. 2).

The parameters of the individual layer superstructures can be adjusted depending on the purpose of use—corrosion resistance or surface to be painted or bonded.

The present invention provides the following advantages, inter alia:

- the invention has the advantage that it can be used for all possible aluminium series, for example for aluminium series used in aircraft construction: AA 7XXX, AA 6XXX, AA 5XXX, AA 2XXX series and AlLi alloys. Semi-finished products include metal sheets, plates, cast iron alloys, extruded parts and forged parts.
- The method of the present invention and the materials used are not carcinogenic or toxic.
- The pre-set surface combines three functionalities: corrosion resistance, suitability as substrate for paints and suitability as a pre-treatment for bonding adherends.
- The parameters can be adapted for the anodised layers according to functionality.

The present invention is directed at the following in particular:

According to a first aspect, the present invention relates to a method for applying a multifunctional coating to the surface of a workpiece consisting of aluminium or an aluminium alloy, the method comprising the following:

a) treating the surface of the workpiece with an acidic solution which contains rare-earth metal ions, to produce a first oxide layer on the workpiece; and b) anodising the workpiece to achieve a second oxide layer, the workpiece serving as anode of an electrical cell in the presence of an aqueous sulphuric acid-containing solution and the first oxide layer obtained in step a) being retained.

Therefore, the method of the present invention combines two elements described in the prior art, namely treating the surface of the workpiece with a solution containing rare-earth metal ions, and an anodising step. A combination of the two steps has previously not been considered since the anodising step and the reaction circumstances used therein were to proceed from a destruction of the first oxide layer produced during the treatment with rare-earth metal ions.

The present invention provides for the first time a combination of the two method steps and provides proof that the formation of two oxide layers is possible by the successive steps and results in particularly advantageous, multifunctional coatings on aluminium workpieces.

According to a preferred embodiment, the rare-earth metal ion used in step a) is cerium (IV). This is used in the form of its salt preferably as cerium (IV) sulphate and/or ammonium cerium (IV) sulphate.

It is also possible to use other rare-earth metal ions, including: praseodymium, neodymium, samarium, europium, terbium and ytterbium ions.

The concentration of the rare-earth metal ions in the acidic solution in step a) is preferably between 0.005 and 1 mol/l, more preferably between 0.01 and 0.5 mol/l. It is particularly advantageous if this concentration is between 0.1 and 0.3 mol/l.

In the method of the present invention, the processing temperature in step a) is set at approximately 50 to 80° C. This process management differs from the parameters stated in U.S. Pat. No. 6,503,565, for which the process starts from temperatures of 50° C. and below.

The first oxide layer produced in step a) preferably has a thickness of approximately 20-100 nm. In this respect, see also FIG. 1 and the illustrated hair brush-like oxide layer. The achieved layer thickness is more preferably approximately 50 nm.

The acidic solution used in step a) preferably has a pH of <1, preferably less than 0.5. In a preferred embodiment, the solution contains sulphuric acid. The use of other acids, for example phosphoric acid is possible, but is less preferred.

The treatment of the workpiece of aluminium or an aluminium alloy in step a) preferably lasts from 2 minutes up to 60 minutes, more preferably approximately 10 minutes.

In step b), a TSA or SAA solution is used as the solution containing sulphuric acid. Both solutions (and the anodising methods based thereon) are basically known in the prior art. For example, EP 1 233 084 discloses a solution of 10 to 200 g/l of sulphuric acid and from 5 to 200 g/l of L (+) tartaric acid to be used in an anodising method. This reference includes the disclosure of EP 1 233 084 in its entirety in the present document.

The TSA solution of the present invention also preferably contains from 10 to 200 g/l of sulphuric acid and from 5 to 200 g/l of L (+) tartaric acid. More precisely, the solution contains from 20 to 80 g/l of sulphuric acid and from 30 to 120 g/l of L (+) tartaric acid. Furthermore, approximately 40 g/l of sulphuric acid and approximately 80 g/l of L (+) tartaric acid are contained in the solution.

The second oxide layer produced in step b) usually has a significantly greater thickness than the first oxide layer and can be in the order of magnitude of approximately 2 to 8 μm.

As described at the outset, the process management in the present method must be selected such that a destruction of the first oxide layer formed in step a) is avoided. In this respect, it is particularly recommended to select a maximum treatment duration of 40 minutes under the conventional process conditions. The preferred treatment duration in step b) is thus from 10 to 40 minutes.

In addition, it is particularly important that in step b), a processing temperature of from 15 to 35° C. is set. With higher temperatures, there is the risk that the first oxide layer (formed in step a)) will very likely be stripped off again. Temperatures below 15° C. usually result in an increased brittleness of the workpiece surfaces and are likewise less preferred.

The workpieces processed in the method according to the invention and based on aluminium alloys are preferably selected from alloys of the AA 7XXX, AA 6XXX, AA 5XXX, AA 2XXX series and from AlLi alloys which are used in aircraft construction. Insofar as the method according to the invention modifies in particular components for the aircraft industry, the method is of course not restricted to this aspect and can, in principle, be applied to any workpiece made of aluminium or aluminium alloys, whether in vehicle construction or in other technical fields.

In a variant, the method of the present invention provides carrying out an additional step of contacting the surface of the workpiece with an alkaline cleaning solution to remove impurities before the steps of treating the workpiece with rare-earth metal ions and anodising the workpiece.

According to a second aspect, the invention relates to a workpiece consisting of aluminium or of an aluminium alloy which has been treated according to the previously described method and has a modified multifunctional surface. The resulting surfaces increase the corrosion protection of the basis material and have a surface structure which is eminently suitable for adhesive bonds and/or painting.

BRIEF DESCRIPTION OF THE DRAWINGS

The present invention will now be described in detail with reference to the figures and the examples.

DESCRIPTION OF EXEMPLARY EMBODIMENTS

Figure 1:
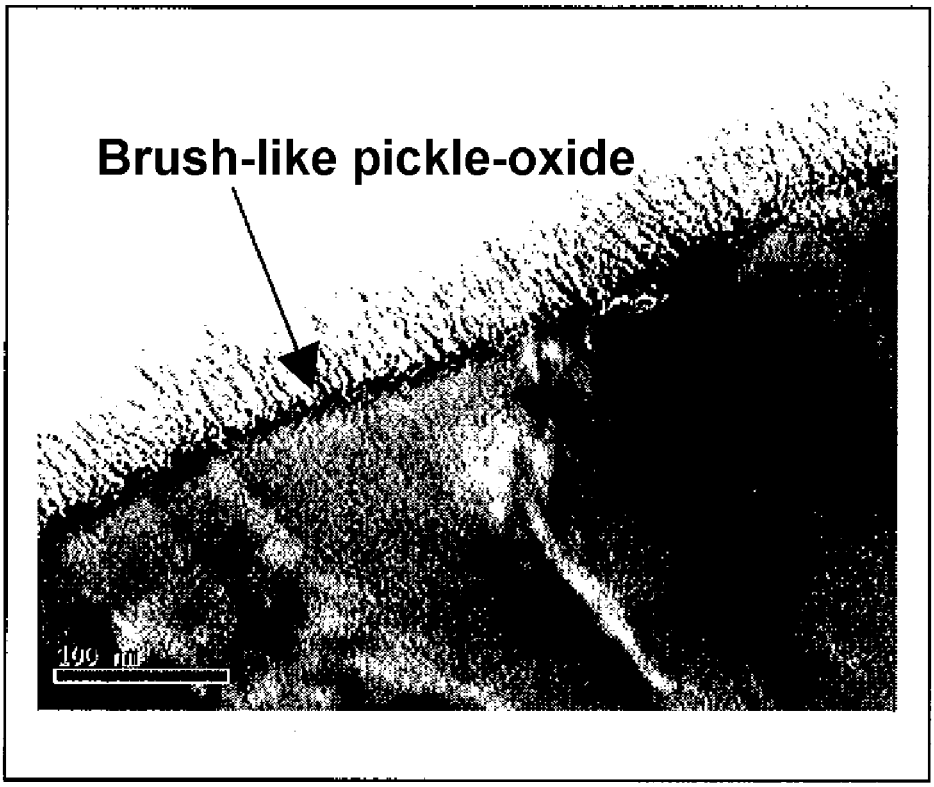
FIG. 1 shows an outer "hair brush-like" surface structure of approximately 60 nm which is achieved in step a) of the method according to the invention.

After a conventional pre-treatment involving degreasing and an alkaline pickling step, the pickling oxide layer is applied to the workpiece, the workpiece is brightened at the same time as a desmut treatment is carried out and the "hair brush-like" outer surface layer of approximately 50 nm is applied. In the anodising step, the workpiece is treated in an anodising bath containing sulphuric acid and adjusted to a layer thickness of approximately 5 μm.

Typical method parameters (suitable for aluminium and aluminium alloys) are as follows:

Pickling Process (First Step of Method):

0.2 mol/l $(NH_4)_4Ce$ (IV) $(SO4)_4$:

2 mol/l $H_2SO_4$

Processing temperature 60° C., processing time: 10 minutes

Anodising TSA (Second Step of Method):

Electrolyte:

| | |
|---|---|
| L(+) tartaric acid | 80 g/l |
| $H_2SO_4$ | 40 g/l |

Anodising parameters: ramp 3 min to 18 V, plateau 20 min at 18 volt

Anodising takes place at 30° C.

A good result was obtained in the following embodiment:

For pre-treatment, the workpiece is degreased for 15 minutes at 65° C. in a typical commercially available scouring degreasing installation (silicate-free, pH 9.5, phosphate/borate skeleton).

Old oxide/hydroxide layers and other surface impurities are pickled for 1 minute at 60° C. by a commercially available alkaline pickling for Al alloys (alternative 1 m NaOH with 5 g/l of gluconate addition). The metal removal is approximately 3 μm.

The workpiece is then pickled until metallically bright at 60° C. for 8 minutes in a 0.2 molar Ce (VI) $(NH_4)_4$ $[SO_4]_4$ solution with sulphuric acid. The oxide build-up is approximately 60 nm. A microscopic photograph of the surface of the workpiece, which reproduces the resulting oxide layer, is shown in FIG. 1.

After sufficient rinsing, anodising is then carried out in a TSA bath (see above) at 25° C. With the application of 18 volts of current, anodised layers of approximately 3 μm are obtained after approximately 20 minutes. The oxide layer produced by Ce (IV) sulphuric acid treatment is reduced after the anodic treatment to approximately 40 nm.

Figure 2:
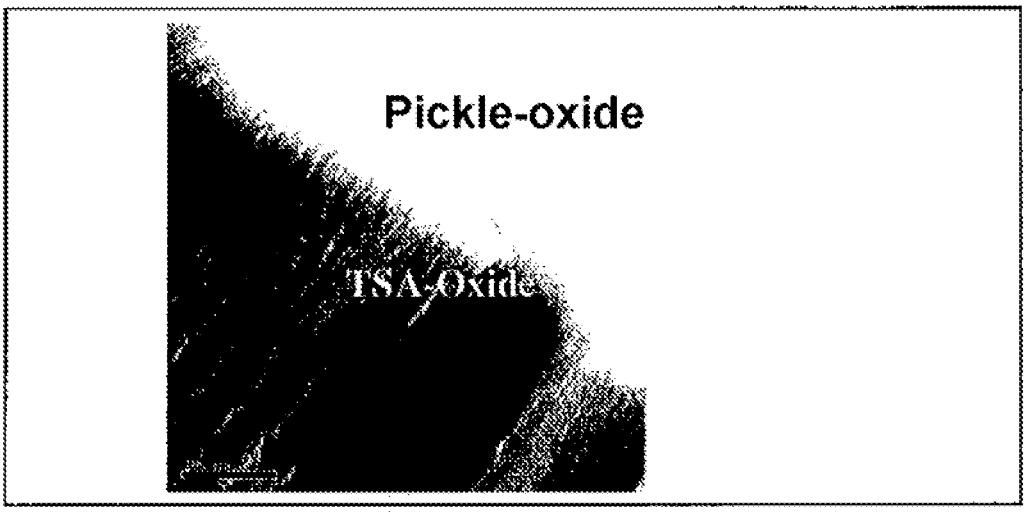
FIG. 2 shows a double oxide layer, as applied to a workpiece consisting of an aluminium alloy by the method of the present invention.

FIG. 2 shows a double oxide layer as applied by this method.

The invention claimed is:

1. A method for applying a multifunctional coating to the surface of an untreated workpiece made of aluminium or of an aluminium alloy, wherein the method comprises the following:

a) treating a surface of the untreated workpiece made of aluminium or of an aluminium alloy with an acidic solution which contains rare-earth metal ions, to produce a treated workpiece with a first oxide layer thereon, wherein the acidic solution has a pH of <1 and the treating of step a) occurs at a processing temperature of 50° C. to 80° C; and b) anodising the treated workpiece to produce a second oxide layer, the treated workpiece serving as anode of an electrical cell in the presence of an aqueous sulphuric acid-containing solution and the first oxide layer produced in step a) being retained, wherein the anodising of step b) occurs at a processing temperature of 15 to 35° C.

2. The method according to claim 1, wherein the rare-earth metal ions are cerium (IV).

3. The method according to claim 1, wherein the concentration of the rare-earth metal ions in the acidic solution in step a) is between 0.005 and 1 mol/l.

4. The method according to claim 1, wherein the first oxide layer produced in step a) has a thickness of from 20 to 100 nm.

5. The method according to claim 1, wherein the solution used in step a) further contains sulphuric acid.

6. The method according to claim 1, wherein the treatment in step a) lasts from 2 minutes to 60 minutes.

7. The method according to claim 1, wherein the rare earth metal ions are selected from the group consisting of praseodymium, neodymium, samarium, europium, terbium and ytterbium ions.

8. The method according to claim 1, wherein a tartaric acid-sulphuric acid (TSA) or a sulphuric acid (SAA) solution is used as the solution containing sulphuric acid in step b).

9. The method according to claim 8, wherein the TSA solution contains from 10 to 200 g/l of sulphuric acid and from 5 to 200 g/l of L (+) tartaric acid.

10. The method according to claim 9, wherein the TSA solution contains from 20 to 80 g/l of sulphuric acid and from 30 to 120 g/l of L (+) tartaric acid.

11. The method according to claim 10, wherein the TSA solution contains approximately 40 g/l of sulphuric acid and approximately 80 g/l of L (+) tartaric acid.

12. The method according to claim 1, wherein a second oxide layer with a layer thickness of from 2 to 8 μm is produced in step b).

13. The method according to claim 1, wherein the anodising duration in step b) is from 10 to 40 minutes.

14. The method according to claim 1, wherein the untreated workpiece is made of the aluminium alloy and the aluminium alloy is selected from alloys of the AA 7XXX, AA 6XXX, AA 5XXX, AA 2XXX series and from AlLi alloys.

15. The method according to claim 1, wherein before treating the untreated workpiece with the rare-earth metal ions and anodising the treated workpiece, there is an additional step of contacting the surface of the untreated workpiece with an alkaline cleaning solution is carried out to remove impurities.

16. The method according to claim 1, wherein following anodizing the treated workpiece, there is a step of utilising the treated workpiece as a component for aircraft construction.

17. The method according to claim 1, wherein the concentration of the rare-earth metal ions in the acidic solution in step a) is between 0.01 and 0.5 mol/l.

18. The method according to claim 1, wherein the concentration of the rare-earth metal ions in the acidic solution in step a) is between 0.1 and 0.3 mol/l.

* * * * *